US005843281A

United States Patent [19]

Huovila

[11] Patent Number: 5,843,281

[45] Date of Patent: Dec. 1, 1998

[54] HEADBOX OF A PAPER MACHINE WITH EDGE FEED ARRANGEMENTS

[75] Inventor: Jyrki Huovila, Muurame, Finland

[73] Assignee: Valmet Corporation, Helsinki, Finland

[21] Appl. No.: 799,270

[22] Filed: Feb. 13, 1997

[30] Foreign Application Priority Data

Jan. 14, 1997 [FI] Finland ..... 970140

[51] Int. Cl.[6] ..... D21F 1/08

[52] U.S. Cl. ..... 162/216; 162/212; 162/258; 162/259; 162/336; 162/343; 162/344

[58] Field of Search ..... 162/258, 212, 162/216, 335, 336, 337, 338, 339, 340, 344, 343, 259

[56] References Cited

U.S. PATENT DOCUMENTS

| | | | |
|---|---|---|---|
| 4,897,158 | 1/1990 | Weisshuhn et al. | 162/259 |
| 4,909,904 | 3/1990 | Kinzler | 162/343 |
| 5,022,965 | 6/1991 | Pitkäjärvi | 162/192 |
| 5,133,836 | 7/1992 | Alleen | 162/343 |
| 5,196,091 | 3/1993 | Hergert | 162/258 |
| 5,470,439 | 11/1995 | Makino et al. | 162/216 |
| 5,545,293 | 8/1996 | Houvila et al. | 162/212 |
| 5,549,793 | 8/1996 | Hellstrom et al. | 162/258 |
| 5,603,806 | 2/1997 | Kertulla | 162/198 |
| 5,626,722 | 5/1997 | Houvila | 162/243 |

OTHER PUBLICATIONS

Finnish Patent No. 85732 (Application No. 912542), Cover Page and Drawings, English–Language Translation of Claim1 and Abstract, Feb. 14, 1992.

*Primary Examiner*—Stanley S. Silverman
*Assistant Examiner*—Jose A. Fortuna
*Attorney, Agent, or Firm*—Steinberg & Raskin, P.C.

[57] ABSTRACT

A headbox of a paper machine which is provided with a dilution profiling system which uses a feedback-connected regulation system to control the cross-direction basis weight profile of the paper web produced by the paper machine. The dilution profiling system includes a feed header for a dilution liquid or for a stock suspension of a consistency lower than the consistency in the headbox, feed ducts fill idly coupled to the dilution header and regulation valves associated with the feed ducts for the dilution liquid, whereby the dilution liquid is passed to an area between a front wall of the inlet header of the headbox and a slice duct of the headbox. In the dilution profiling system, edge feed arrangements are integrated in both lateral areas of the headbox. The edge feed arrangements include ducts by whose means it is possible to pass edge flows from the inlet header of the dilution profiling system into both of the lateral areas of the headbox, which edge flows have velocities and/or mutual velocity ratios that can be set and/or regulated. By means of the edge flows, a controlled transverse velocity component is produced in the stock suspension jet so as to control the cross-direction fiber orientation profile.

28 Claims, 5 Drawing Sheets

HEADBOX OF A PAPER MACHINE WITH EDGE FEED ARRANGEMENTS

FIELD OF THE INVENTION

The present invention relates to a headbox of a paper machine which is provided with a dilution profiling system by whose means, by making use of a feedback-connected regulation system, the cross-direction basis weight profile of the paper web is controlled. The dilution profiling system comprises a feed header for a dilution liquid or for a stock suspension having a consistency lower than the consistency of the stock in the headbox, feed ducts fluidly connected to the feed header, and regulation valves arranged in association with the feed ducts for regulating the flow of the dilution liquid through the feed ducts. The feed ducts lead to an area between a front wall of an inlet header of the headbox and a slice duct of the headbox, most appropriately into the ducts in a turbulence generator placed in that area.

The present invention also relates to a method for controlling the cross-direction fiber orientation profile of a paper web produced from a stock suspension jet discharged from a headbox and the basis weight profile of the web.

BACKGROUND OF THE INVENTION

As is known from the prior art, the slice flow of stock suspension in the headbox should have a uniform velocity in the cross direction of the paper machine, i.e., in the direction of width of the web. Likewise, it is own that in this flow, a detrimentally high transverse velocity can occur. In particular in the lateral areas of the web this has been detrimental, for example, in the form of strengthening of the edge wave. These known requirements have been imposed in order that it should be possible to produce a paper with homogeneous basis weight, formation and strength properties across the entire width of the web and in order that a proportion of the web as small as possible needs to be cut off from the edges of the web in view of its unsuitability for use.

In view of meeting these requirements, it is known in the prior art, among other things, to construct the headbox with flow modifying features, for example to use a solution in which a small proportion of the stock flow is removed through both side walls of the slice duct of the headbox before the stock flow is discharged onto the wire (e.g., as described in Finnish Patent No. 43,812 in the name of Beloit Corporation). A contrary solution, in which an additional flow of water is passed through the side wall, is also known (Finnish Patent No. 30,095 in the name of Valmet Oy), even though the latter solution has not been accomplished in practice, at least not by the current assignee. Regarding the prior art related to the present invention, reference is also made to the U.S. Pat. No. 5,560,807 (assigned at issuance to Beloit Technologies, Inc.). An uncontrolled transverse velocity of the flow in a headbox may produce distortion of the fiber orientation profile in the web, which has an effect on the quality factors of the paper produced, such as on dimensional stability of the paper in connection with changes in moisture. The aim during paper production is that the main axes of the directional distribution, i.e., orientation, in the fiber mesh in the paper should coincide with the directions of the main axes of the paper and that the orientation should be symmetric in relation to these axes.

At the edges of the stock flow duct in the headbox, of course, owing to the vertical walls, there is a higher friction, which is commonly called the "edge effect". This edge effect produces a strong linear distortion in the fiber orientation profile. Profile faults of the turbulence generator in the headbox usually produce non-linear distortion in the profile inside the lateral areas of the flow ducts.

Attempts have been made to compensate for the unevenness of the basis weight profile arising from the drying-shrinkage of the paper by crown formation of the slice opening so that the slice opening is thicker in the middle of the stock jet. When the paper web is dried, the web shrinks in its middle area less than in its lateral areas, and the shrinkage is generally about 1% to about 3% in the middle areas and in the lateral areas the shrinkage is about 4% to about 6%. The shrinkage profile produces a corresponding change in the cross direction basis weight profile in the web, so that, owing to the shrinkage, the dry basis weight profile of a web whose cross-direction basis weight profile after the press section was uniform is changed during drying so that both of the lateral areas of the web have a slightly higher basis weight than the middle areas. In a manner known in the prior art, the basis weight profile is regulated by means of the adjustable top slice bar of the slice opening so that the top slice bar is kept more open in the middle area than in the lateral areas. By means of such an arrangement, the stock suspension is forced to move towards the middle area of the web, which further affects the profile of the fiber orientation.

For the purpose of controlling these problems, what are commonly called edge feed arrangements have been suggested, with respect to which reference is made, by way of example, to the current assignee's U.S. Pat. No. 4,687,548 (incorporated by reference herein) and to the corresponding Finnish Patent Nos. 70,616 and 75,377. In these prior art edge feed arrangements, the adjustable edge flows are taken from the inlet header of the headbox so that the edge flows are composed of the suspension in the headbox, i.e., one and the same stock suspension. The edge flows are passed to both of the lateral areas of the headbox out of the inlet header either through by-pass pipes placed outside the headbox or by using adjustable lateral ducts in both of the lateral areas in the turbulence generator of the headbox.

In recent years, what are called dilution headboxes have become common, in which headboxes, in the cross direction of the headbox, the basis weight profile is adjusted by feeding a regulated amount of dilution liquid, for example wire water or stock suspension of a lower consistency than the stock in he headbox, into different feed points in the cross direction of the headbox. With respect to the se prior art dilution headboxes, reference is made, by way of example, to the current assignees Finnish Patent No. 92,229 (corresponding to European Patent Publication No. 0 633 352 A1 and U.S. patent application Ser. No. 08/269,345, which is incorporated by reference herein).

OBJECTS AND SUMMARY OF THE INVENTION

It is an object of the present invention to further develop the prior art headboxes provided with dilution profiling systems.

It is a particular object of the present invention to provide a dilution headbox having a simple construction and embodiment in which the prior art edge flow arrangement can be applied in a novel advantageous way mainly in view of controlling the cross direction fiber orientation distortion (profile) in the web.

It is another object of the invention to provide a new and improved method for controlling the cross-direction fiber orientation profile of a paper web produced from a stock suspension jet discharged from a headbox and the basis weight profile of the web.

In view of achieving the objects stated above, those that will come out later and others, the invention is mainly characterized in that, in the dilution profiling system, edge feed arrangements are integrated and are arranged in both of the lateral areas of the headbox. The edge feed arrangements comprise ducts by whose means it is possible to pass edge flows from the inlet header of the dilution profiling system into both of the lateral areas of the headbox, which edge flows have velocities and/or mutual velocity ratios that can be set and/or regulated to provide the desired effect. By means of the edge flows, a controlled transverse velocity component is produced in the stock suspension jet in the headbox and/or upon its discharge therefrom and so as to control the cross-direction fiber orientation profile of the web.

In the present invention, both the prior art dilution profiling system and the edge feed arrangement in itself known from the prior art (but which do not operate in combination with one another) have been combined in a novel synergistic manner so that a headbox having a simple construction and easy operation and maintenance is provided.

By means of the present invention, other substantial advantages of practical significance are also provided, such as the fact that the feed pressure of the lateral edge feeds need not be confined to the pressure loss in the headbox, in which case a wider range of regulation is obtained for the regulation of the cross-direction profile of the fiber orientation.

According to the invention, when the dilution water of the dilution profiling system is used as the edge flow, formation of lateral splashes in the wire part is also prevented and a wire part is obtained that remains clean in operation, cleaner than in prior art constructions.

The edge feed arrangement in accordance with the invention has no detrimental effect on the cross-direction basis weight profile of the web, because, in any case, from both edges of the web, trim strips of a width of about 10 cm to about 15 cm are cut off, whereas the edge feeds in accordance with the invention are extended preferably to a width of only about 5 cm.

It is a further advantage of the present invention that the lateral areas of the paper web do not become thicker than the middle area, which facilitates the handling of the web in and after the wire part.

The invention carries to effect the essential advantages of synergism of a dilution profiling system and of edge feed arrangements. One of the most important ones of these advantages is the possibility to integrate the systems of pumping and processing the dilution water and the edge feed liquid.

In a basic environment of the invention, the headbox of the paper machine includes a dilution profiling system utilizing a feedback-connected regulation system to control the cross-direction basis weight profile of a paper web produced by the paper machine, and more specifically, an inlet header for stock having a front wall, a slice duct from which a suspension jet of the stock is discharged from the headbox, and a turbulence generator arranged between the front wall of the inlet header and the slice duct. The dilution profiling system includes a dilution feed header for a dilution liquid, such as a stock suspension having a consistency lower than the consistency of the stock in the headbox, feed ducts fluidly coupled to the dilution header and leading to an area between the front wall of the headbox and the slice duct, and a regulation valve associated with each of the feed ducts for regulating the flow of dilution liquid therethrough. IN accordance with the invention, the headbox also includes conduit means for passing flows of the dilution liquid from the dilution header to the stock flowing in the end regions along lateral edges of the headbox to thereby form edge flows, and control means for regulating the velocity of each of said edge flows to control a transverse velocity component of the stock suspension jet such that the cross-direction fiber orientation profile of the web produced from the stock suspension jet is controlled. In certain embodiments, each feed duct is fluidly coupled to the turbulence tubes in a respective vertical row of turbulence tubes in the turbulence generator.

In one notable embodiment, the turbulence generator has first and second lateral edges and includes a first set of at least one lateral tube arranged at the first lateral edge and a second set of at least one lateral tube arranged at the second lateral edge. The conduit means comprise first and second by-pass pipes leading from the dilution header to the first and second sets of one or more lateral tubes in the turbulence generator, respectively, and the control means comprising an adjustable regulation valve arranged in connection with each by-pass pipe. In this case, the conduit means may comprise a distribution piece arranged at each lateral edge of the turbulence generator in a middle portion of the turbulence generator between the inlet header and the slice duct and each by-pass pipe leads into a respective distribution piece. If the sets of one or more lateral tubes have a plurality of lateral tubes in a vertical row, then each distribution piece may comprise a flow duct which extends substantially over the entire height of the turbulence generator and is fluidly coupled to the respective plurality of lateral tubes of the turbulence generator.

A basic embodiment of the method for controlling the cross-direction fiber orientation profile of a paper web produced from a stock suspension jet discharged from a headbox and the basis weight profile of the web comprises the steps of directing a stock suspension from an inlet header of the headbox through a plurality of turbulence tubes in a turbulence generator, the turbulence tubes being situated alongside one another in a direction transverse to the stock flow direction and in vertical rows, directing a dilution liquid from a dilution header through a plurality of feed ducts each leading into a respective vertical row of turbulence tubes, and regulating the flow of dilution liquid through each feed duct to thereby control the basis weight profile of the web. To control the fiber orientation profile, flows of the dilution liquid are passed from the dilution header to the stock flowing in the end regions along lateral edges of the headbox to thereby form edge flows, and the velocity of each edge flow is regulated to control a transverse velocity component of the stock suspension jet. To enhance the system, the basis weight profile of the web may be measured at a location downstream of the headbox, and then the flow of dilution liquid through each feed duct regulated based on the measured basis weight profile of the web. Similarly, the fiber orientation profile of the web may be measured at a location downstream of the headbox, and then the regulating the velocity of each edge flow regulated based on the measured fiber orientation profile of the web.

In the following, the invention will be described in detail with reference to some exemplifying embodiments and environments of application of the present invention, the invention being in no way confined to the details of these embodiments or environments.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
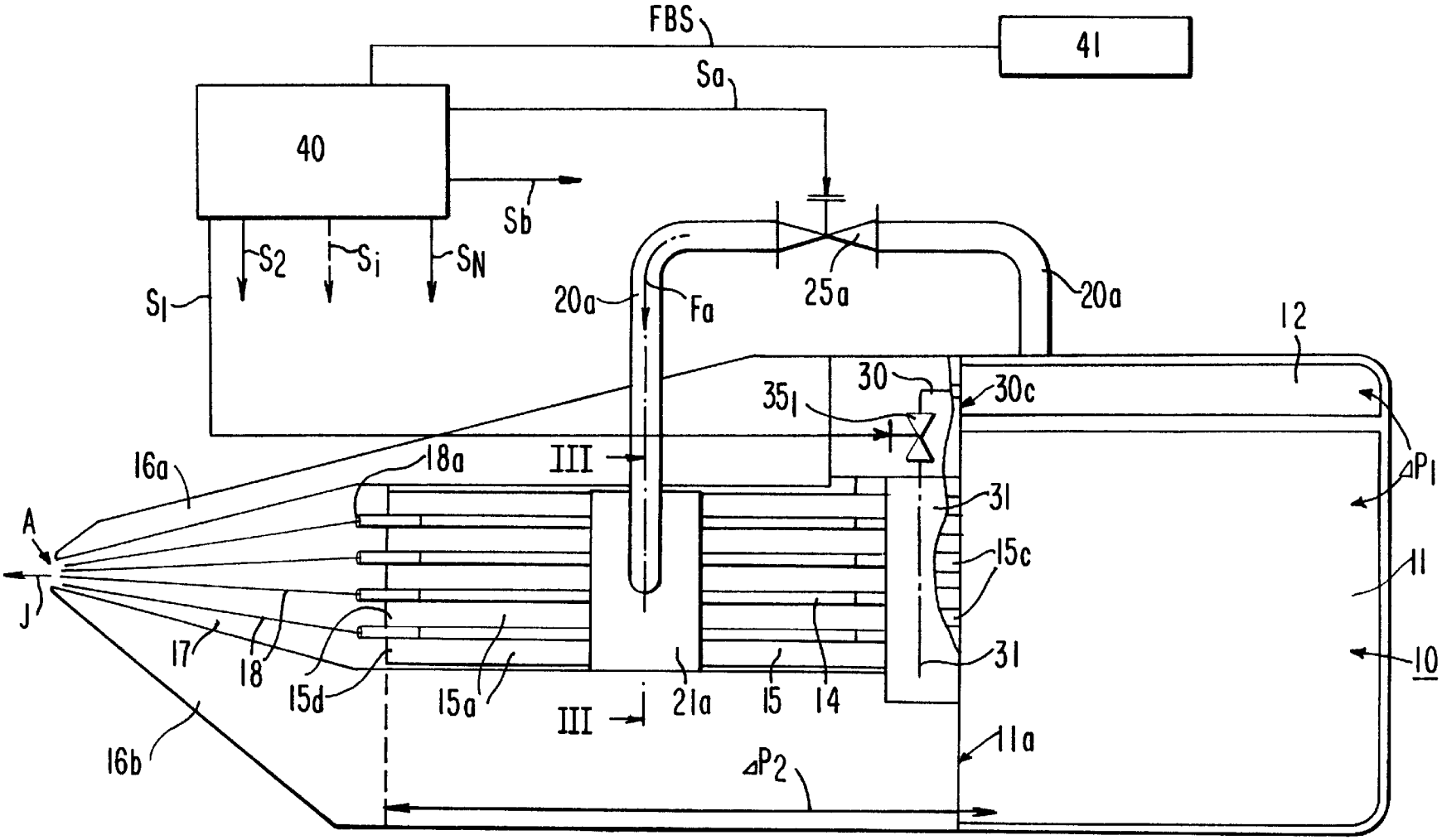
FIG. 1 is a schematic side view of a headbox, in which a first embodiment of an edge feed arrangement in accordance with the invention is applied.
Figure 2:
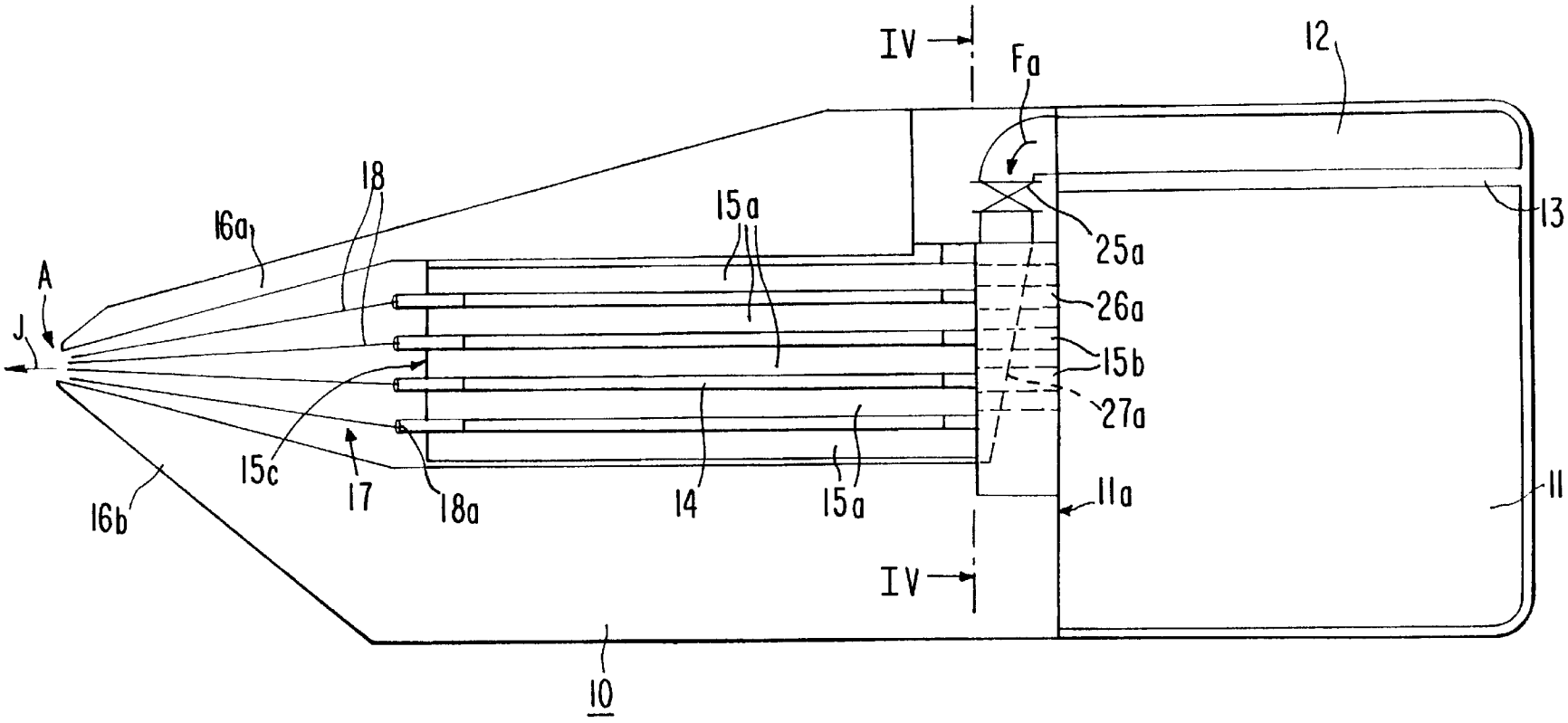
FIG. 2 is an illustration corresponding to FIG. 1 of a second embodiment of the invention.
Figure 5:
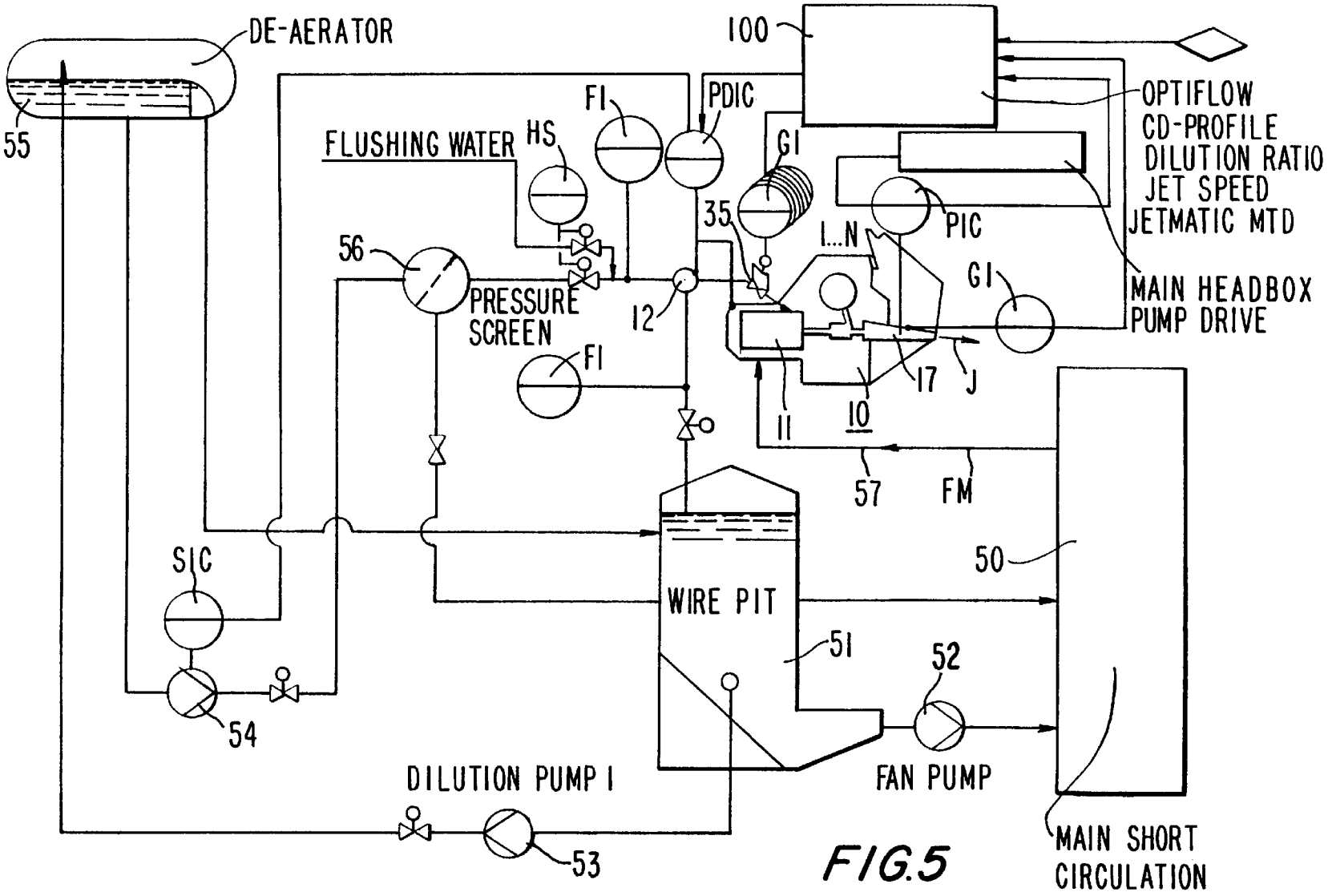
FIG. 5 is a schematic illustration wider than FIGS. 1–4 of an environment of application of the present invention and the elated regulation system as a process and block diagram.

Referring to the accompanying drawings wherein the same reference numerals refer to the same or similar elements, a headbox 10 of a paper machine shown in FIGS. 1 and 2 comprises an inlet header 11 into which a stock suspension flow FM (FIG. 5) is fed from the stock system through the main stock pipe 57 (FIG. 5). The inlet header 11 is followed by a turbulence generator 14 in the stock flow direction. The turbulence generator 14 comprises a plurality of rows of turbulence tubes 15 placed one row above the other (five in the illustrated embodiment), and upstream ends 15*c* of the turbulence tubes are opened into a front wall 11*a* of the inlet header 11. Downstream ends 15*d* of the turbulence tubes 15 are opened into a slice duct 17 which is defined between an upper-lip wall 16*a* and a lower-lip wall 16*b*. Between the horizontal rows of the downstream orifices at ends 15*d* of the turbulence tubes 15, thin, plate-like vanes 18 are attached by means of articulated joints 18*a*, which vanes extend up to a slice opening A of the slice duct 17 or to the vicinity of the opening A. From the slice opening A, a stock suspension jet J is discharged onto a forming wire or into a gap between forming wires (not shown). The cross-direction profiles of the discharge jet J are regulated by means of the dilution profiling system, which will be described later. The turbulence tubes 15 are usually placed in aligned vertical and horizontal rows across substantially the entire width of the headbox.

In the present invention, a distortion of the cross-direction fiber orientation profile of the web is controlled in compliance with the same principles by making use of edge flows Fa and Fb, which can be regulated or set as needed. The principles of this control were already discovered by the current assignee in about 1984, and in this respect reference is made to the current assignee's U.S. Pat. No. 4,687,548 and to the corresponding Finnish Patent Nos. 70,616 and 75,377 which describe the same. These edge flows are constituted by the normal headbox stock suspension.

Differing from that described above, the environment of application of the present invention can be, for example, a headbox which comprises, in the flow direction of the stock suspension, first an inlet header, then a stilling chamber of a distribution manifold, a turbulence generator, and finally a slice duct, which can also be free from the vanes 18 shown in FIGS. 1 and 2. In this environment of application, the adjustable edge flows Fa and Fb are preferably, but not required to be, passed in the area of the turbulence generator in the ducts in its lateral portions. The present invention may also be used with other headbox constructions.

The edge feed arrangement in accordance with the present invention has been integrated in a novel way expressly in connection with a dilution profiling headbox. The dilution profiling system in itself known comprises an inlet header 12 for dilution liquid, which is usually wire water, which is in FIGS. 1 and 2 arranged above the inlet header 11 proper and separated from the inlet header 11 by a partition wall 13. The dilution profiling system is shown clearly in FIGS. 1, 2 and 4. From the dilution header 12, distribution pipes 30 are passed through a series of regulation valves $\mathbf{35}_1, \ldots, \mathbf{35}_N$ into distribution pipes 31, from which horizontal feed ducts 32 are opened into the vertical rows of turbulence tubes 15 in the middle region of the turbulence generator 14 between lateral edges thereof. Thus, for each vertical row of turbulence tubes 15 there is one set of dilution-liquid distribution pipes 30,31,32 which starts from an upstream orifice 30*c* of distribution pipe 30 opening into the dilution header 12 and which ends when the feed ducts 32 are opened into the turbulence tube 15. Each distribution pipe 30 includes one regulation valve 35 therein, independently regulated with a view toward controlling the cross-direction basis weight profile of the stock suspension jet, and leads to one of the distribution pipes 31 after the regulation valve 35. The distribution pipes 31 and feed ducts 32 fluidly coupled thereto may be situated in a forward portion of the turbulence generator 14 adjoining the front wall of the inlet header. Dilution liquid flows $FD_1, \ldots, FD_N$, adjustable by means of the series of regulation valves $\mathbf{35}_1, \ldots, \mathbf{35}_N$, are passed through the pipes 30,31,32 into the vertical rows of turbulence tubes 15, in which the flows of dilution liquid are mixed with the main stock flow efficiently, and in this way a system of cross-direction profiling of the basis weight of the paper web produced is provided. With respect to combining together the main stock flow and the dilution flows and to various environments of application of the invention, reference is made, by way of example, to the current assignee's Finnish Patent Application Nos. 946180 and 946181 (parent application FI 901593, date of origin Mar. 30, 1990, inventor Risto Savia).

In FIG. 1, the system of regulation of the dilution profiling is illustrated schematically as the block 40. From this block 40, a series of regulation signals $S_1, \ldots, S_N$ pass to the series of regulation valves $\mathbf{35}_1, \ldots, \mathbf{35}_N$. The regulation system 40 receives a feedback signal FBS from a frame 41 of measurement of the cross-direction profile of the basis weight of the paper web, which frame is fitted in the dry end (not shown) of the paper machine in a way in itself known. The feedback signal may be used to affect the operation of the regulation system, i.e., control the regulation valves 35 to feed variable amount of dilution liquid into the main stock flow at different transverse locations.

In accordance with the invention, the edge feed arrangement has been integrated with the dilution profiling system described above primarily for the purpose of controlling the cross-direction fiber orientation profile of the web. Above and in the following, the reference denotations a and b have been used with the reference numerals of the edge flow devices. The parts provided with the reference denotations a are seen in FIGS. 1–4, but the parts provided with the reference b have largely not been shown, because they are identical parts placed in the opposite lateral portion of the headbox in the cross direction. It can be imagined that the parts provided with reference denotations b are seen in imaginary mirror images of FIGS. 1–4. As shown in FIG. 1, from the regulation system 40 the regulation signals Sa and Sb are passed, by whose means the regulation valves 25*a* and 25*b* of the edge flows $F_a$ and $F_b$, are controlled ($F_a$ being the edge flow on the left side of the headbox as shown in FIG. 1 and $F_b$ being the edge flow on the right side of the headbox (not shown)). In general, the edge flows are formed by the passage of the dilution liquid or stock suspension having a consistency lower than the consistency of the stock in the main inlet header 11 of the headbox from the dilution header 12 to the stock flowing in the end regions along lateral edges of the headbox. The regulation signals Sa and Sb can represent either manual control, in addition to which, or as an alternative to which, it is possible to use closed/feedback-connected regulation systems and devices of measurement of fiber orientation profile, even on-line measurement devices. This feedback-connected system of control of fiber orientation is partly also illustrated by the measurement frame 41 and by the feedback signal FBS.

Figure 3:
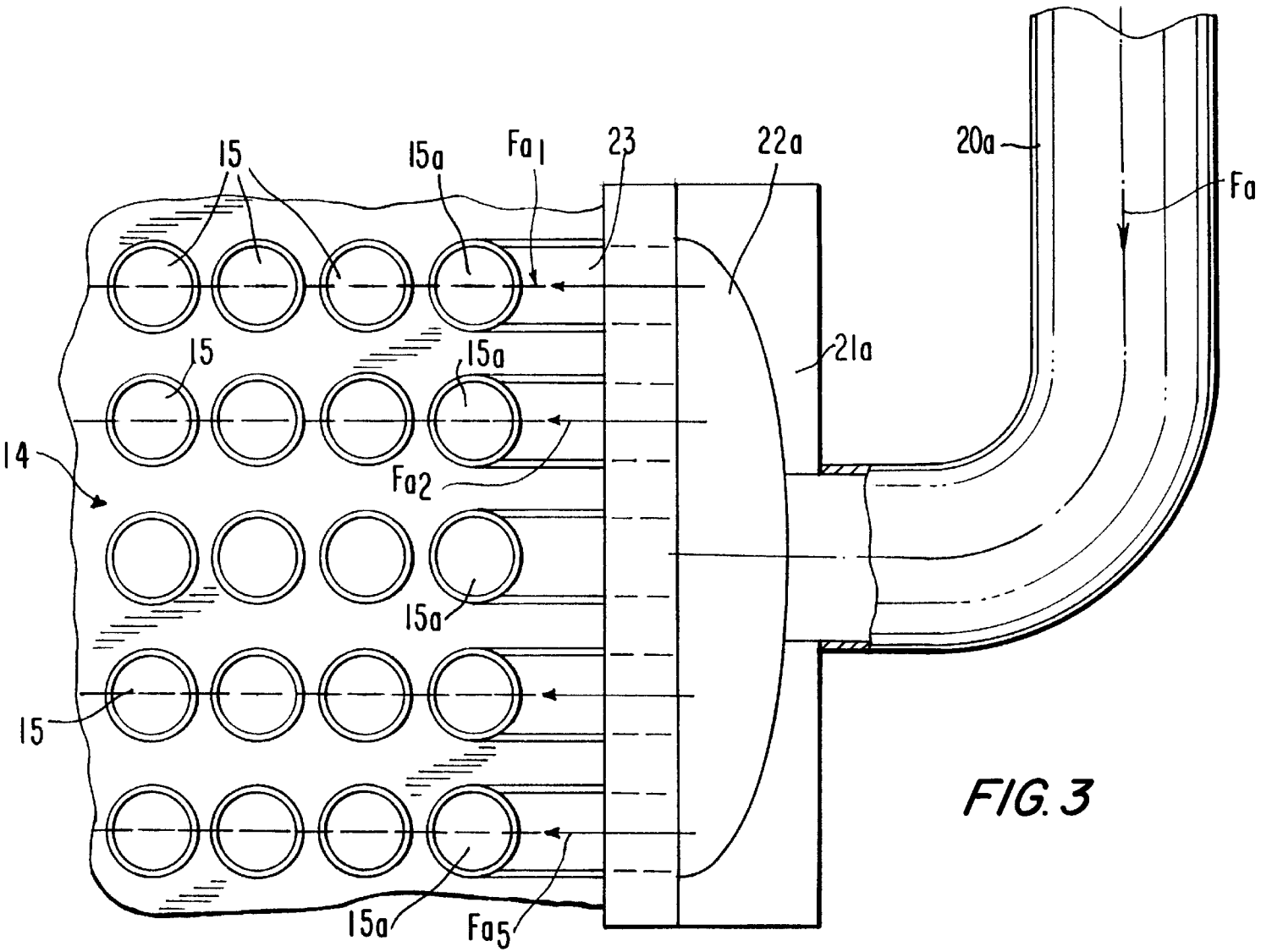
FIG. 3 is a vertical sectional view taken along the line III—III in FIG. 1.

In the following, with reference to FIGS. 1 and 3, a first embodiment of the invention is described, in which there are conduit means such as by-pass pipes 20*a*,20*b* in both of the lateral areas of the headbox 10, which by-pass pipes are passed from the inlet header 12 for dilution liquid to a middle area of the turbulence generator 14 of the headbox in both lateral areas of the headbox, i.e., on both lateral sides or edges of the turbulence generator 14. The by-pass pipes 20*a*,20*b* are opened into a respective distribution piece 21*a*,21*b* arranged in the middle area of the turbulence generator 14 on the respective side of the turbulence generator 14.

Horizontal flow ducts 23*a*,23*b* pass from the distribution pieces 21*a*,21*b* into the lateral ducts 15*a*,15*b* at the respective side of the turbulence generator 15. In the lateral areas of the turbulence generator 14 in the upstream area of the lateral ducts 15*a*,15*b* there are not necessarily turbulence tubes 15 that are opened into the inlet header 11, but if such tubes are used, they can be closed, for example, at the front wall 11*a* of the inlet header 11. In other words, the flow ducts 23*a*,23*b* may lead to an initial portion of the lateral ducts or tubes 15*a*,15*b* such that the lateral tubes are not directly fluidly connected to the inlet header. As an alternative, it is possible to use lateral ducts 15*a*,15*b* extending over the entire length of the turbulence generator 14 in the flow direction, in which case the edge flows Fa and Fb are combined with the "normal" stock suspension flows in the lateral ducts 15*a*,15*b* (from the inlet header), and in the downstream portion of the lateral ducts 15*a*,15*b* after the by-pass pipes 20*a*,20*b* there is a combined flow of edge flows Fa and Fb and "normal" flows. The lateral ducts 15*a*,15*b* may optionally be associated with a set of distribution pipes 30,31,32. The edge flows Fa and Fb are divided as component flows $Fa_1, \ldots, Fa_5$, $Fb_1, \ldots, Fb_5$ into a respective one of the lateral ducts 15*a*,15*b* , i.e., those ducts in the vertical row at each edge or side of the headbox. By setting or regulating the flow velocities and/or the mutual ratios of the velocities of the edge flows Fa,Fb, it is possible to produce a transverse velocity in the stock suspension jet J, by means of which transverse velocity, a possible distortion of the fiber orientation profile is compensated for, for example, in accordance with the principles suggested in U.S. Pat. No. 4,687,548 and Finnish Patent Nos. 70,616 and 75,377.

Figure 4:
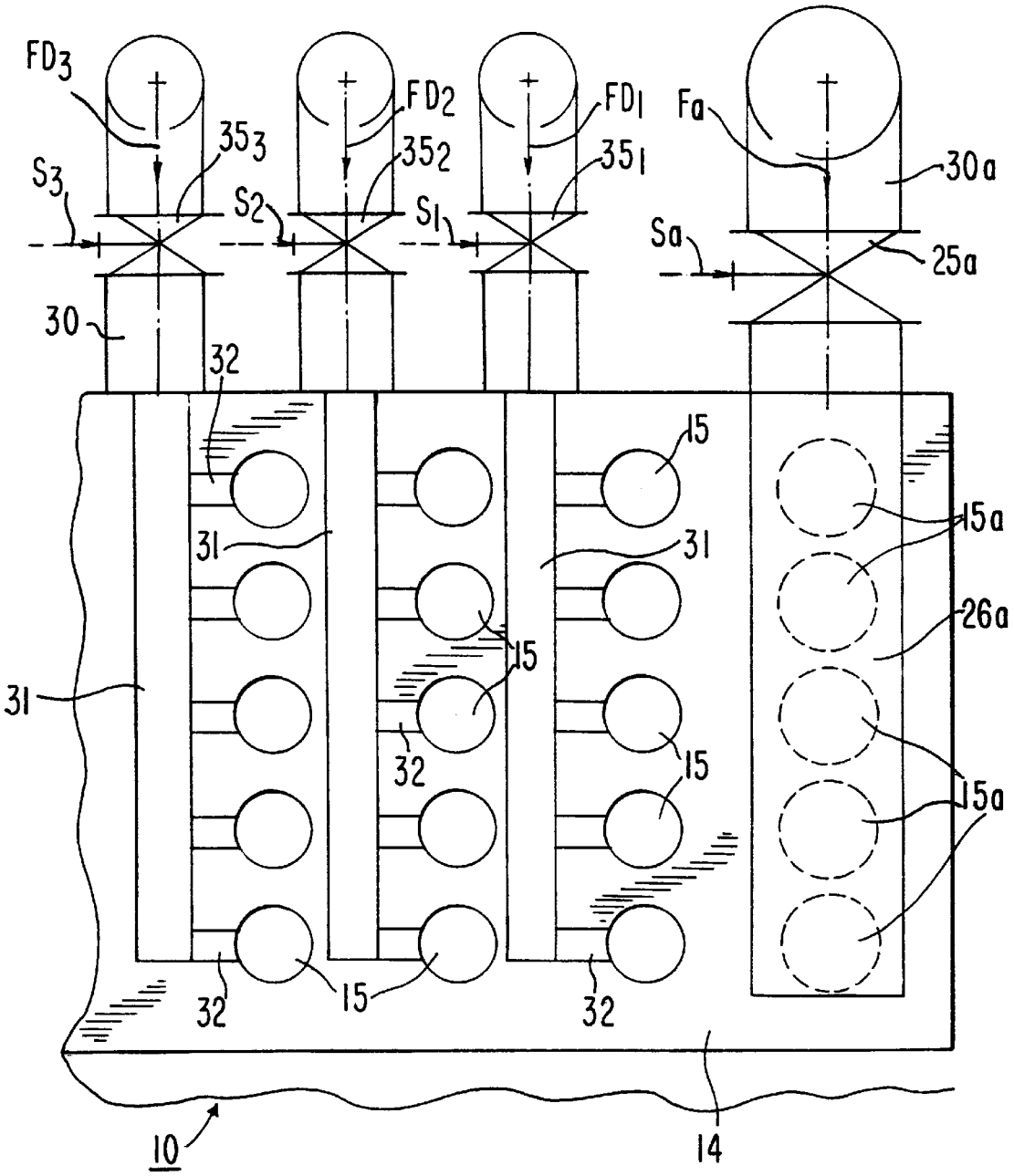
FIG. 4 is a vertical sectional view taken along the line IV—IV in FIG. 2.

According to a second embodiment of the invention shown in FIGS. 2 and 4, inlet headers 26*a*,26*b* for the edge flows Fa,Fb communicate with the lateral ducts 15*a*,15*b* placed at both sides of the turbulence generator 14 of the headbox 10, preferably with the vertical rows of the lateral ducts at a respective side. The lateral ducts 15*a*,15*b* are not connected to the inlet header 11. The headers 26*a*,26*b* include a respective distribution piece 27*a*,27*b* each having a flow duct which becomes narrower in the direction of the flows Fa,Fb and which is fluidly coupled to respective ones of the lateral flow ducts 15*a*,15*b* which belong to the turbulence generator 14 and extend over its entire length in the flow direction. The cross sectional area and flow area of the lateral ducts 15*a*,15*b* is preferably larger than the cross-sectional flow area of the normal turbulence tubes 15, but may of course be any size in relation to the normal turbulence tubes 15. The edge flows Fa and Fb are passed from the dilution header 12 through the pipes 30*a*,30*b* and the regulation valves 25*a*,25*b* into the distribution pieces 27*a*, 27*b* and further into the vertical rows of the lateral ducts 15*a*,15*b* . The regulation valves 25*a*,25*b* of the lateral flows are controlled by means of the regulation signals Sa and Sb received from the regulation system 40 (FIG. 1).

The dilution profiling system can be carried into effect in a number of modes differing from that described above. As an example of such alternative modes, reference is made to the current assignee's Finnish Laid-Open Publication No. 92,229 mentioned above.

When the dilution profiling system is integrated with the edge feed arrangement in accordance with the invention, for the edge feeds a difference in pressure substantially higher than in the prior art is available, which is illustrated by the following example, in which the pressure parameters are indicated in FIG. 1. In the current assignee's headboxes, the difference in pressure between the inlet header and the slice duct is normally, for example, $\Delta P_2 \approx 0.8$ bar (FIG. 2), which corresponds to the difference in pressure of the edge feeds used in connection with the current assignee's prior art edge feed arrangement. The pressure used in the inlet header for dilution liquid in a dilution headbox is typically higher than the above pressure, the pressure being, for example, $\Delta P_1 \approx 3$ bar. This difference in pressure $\Delta P_1$ and the above difference in pressure $\Delta P_2$, added together $\approx 3.8$ bar, is available in the edge feeds in accordance with the present invention.

When the dilution profiling system is used, the headbox can be run with a slice opening A of uniform width. Moreover, the CD (cross direction) basis weight regulation based on cross-direction profiling of the slice opening can be omitted completely, or this profiling can be used just for basic adjustment and equalization of the slice opening A. This results in the advantage, which is in itself known, that local poorly controllable transverse flows in the stock suspension jet can be substantially eliminated.

FIG. 5 is a schematic illustration wider than FIGS. 1–4 of an example of an environment of application of the edge feed arrangement in accordance with the present invention. FIG. 5 also shows the system of regulation 100 of the headbox, which includes the system of regulation 40 shown in FIG. 1. By means of the system of regulation 100, the CD profiles of the paper machine, the dilution ratio, and the speed of the discharge jet J are controlled. The stock feed system shown in FIG. 5 includes a wire pit 51, which communicates with a short circulation 50 of the paper machine through a pump 52, from which short circulation 50 the main stock flow FM is obtained, which is passed through a main stock pipe 57 into the inlet header 11 of the headbox 10. The wire pit 51 communicates with a first feed pump 53 of dilution liquid, which pump passes the dilution liquid into a de-aerator 55. From the de-aerator 55, the dilution liquid is pumped by pump 54 through a pressure screen 56 into the dilution header 12, which can, unlike the dilution header shown in FIGS. 1 and 2, also be separate from the header 11 of the headbox. From the header 12, the dilution flows $FD_1, \ldots, FD_N$ are fed through the series of regulation valves $35_{1, \ldots N}$ into the set of distribution tubes 15 in the turbulence generator 14 in the manner described above. Other conventional components of a headbox are shown in FIG. 5.

Above, only two preferred embodiments of the invention have been described, but many other embodiments and variations are possible within the scope of the inventive idea. Nor is the invention in any way confined to the environment of application illustrated above in FIGS. 1, 2 and 5, but many other environments are also possible, provided that in them a system of profiling of the CD basis weight of the web is employed, with which system the edge feed arrangement in accordance with the present invention is integrated. As an example of an alternative environment of application of the invention, reference is made to the headbox shown in FIG. 1 in U.S. Pat. No. 4,687,548 (equivalent to Finnish Patent Nos. 70,616 and 75,377), which headbox comprises, in the stock-suspension flow direction, in the sequence listed, an inlet header (20), a distribution manifold (19), a stilling chamber (18), a turbulence generator (16), and a slice duct (15). In this environment of application, the edge flows Fa and Fb in accordance with the invention, described above, are passed preferably to the level of the turbulence generator (16).

In the following, the patent claims will be given, and the different details of the invention can show variation within the scope of the inventive idea defined in the claims and differ even to a considerable extent from what has been stated above by way of example only. In other words, the examples provided above are not meant to be exclusive and many other variations of the present invention would be obvious to those skilled in the art, and are contemplated to be within the scope of the appended claims. For example, it is pointed out that although a dilution header is used to provide a dilution liquid or a stock having a consistency lower than the consistency of the stock in the main inlet header, the dilution header may be constructed to provide a stock simply having a different consistency than the stock in the main inlet header.

I claim:

1. A headbox of a paper machine having a width, lateral edges and a middle region defined between the lateral edges along the width of the headbox, comprising an inlet header for stock having a front wall, a slice duct from which a suspension jet of the stock is discharged, and a turbulence generator arranged between the front wall of the inlet header and the slice duct, a dilution profiling system utilizing a feedback-connected regulation system to control the cross-direction basis weight profile of a paper web produced by the paper machine, said dilution profiling system comprising a dilution feed header for a dilution liquid or a stock suspension having a consistency lower than the consistency of the stock in the inlet header, feed ducts fluidly coupled to the dilution feed header and leading to the middle region of the headbox along the width of the headbox and between the front wall of the inlet header and the slice duct, and a regulation valve associated with each of the feed ducts for regulating the flow of dilution liquid therethrough, the headbox further comprising conduit means arranged between the dilution feed header and said lateral edges of the headbox for passing flows of the dilution liquid or stock suspension having a consistency lower than the consistency of the stock in the inlet header from the dilution feed header along said lateral edges of the headbox to thereby constitute edge flows, and control means arranged in connection with said conduit means for regulating the velocity of each of said edge flows to control a transverse velocity component of the stock suspension jet such that the cross-direction fiber orientation profile of the web produced from the stock suspension jet is controlled.

2. The headbox of claim 1, wherein the turbulence generator includes a plurality of turbulence tubes arranged in aligned vertical and horizontal rows in the middle region of the headbox, each of the feed ducts being fluidly coupled to the turbulence tubes in a respective one of the vertical rows of the turbulence tubes.

3. The headbox of claim 1, wherein the turbulence generator has first and second lateral edges adjacent a respective lateral edge of the headbox and includes a first set of at least one lateral tube arranged at the first lateral edge and a second set of at least one lateral tube arranged at the second lateral edge, said conduit means comprising first and second by-pass pipes leading from the dilution header to the first and second sets of at least one lateral tube in the turbulence generator, respectively, said control means comprising an adjustable regulation valve arranged in connection with each of said first and second by-pass pipes.

4. The headbox of claim 3, wherein said conduit means further comprise a distribution piece arranged at each of the first and second lateral edges of the turbulence generator in a middle portion of the turbulence generator between the inlet header and the slice duct, each of said first and second by-pass pipes leading into a respective one of said distribution pieces.

5. The headbox of claim 4, wherein said first and second sets of at least one lateral tube each comprises a plurality of lateral tubes, each of said distribution pieces comprising a flow duct which extends substantially over the entire height of the turbulence generator and is fluidly coupled to the respective plurality of lateral tubes of the turbulence generator, said first and second by-pass pipes leading into one end of a respective one of said flow ducts.

6. The headbox of claim 5, wherein said flow ducts lead into the respective plurality of lateral tubes of the turbulence generator at a initial end of said lateral tubes such that said initial end of each of said lateral tubes is not fluidly connected to the inlet header and only the dilution liquid or stock suspension having a consistency lower than the consistency of the stock in the inlet header flows through said lateral tubes.

7. The headbox of claim 1, wherein the turbulence generator has first and second lateral edges adjacent a respective lateral edge of the headbox and includes a first set of at least one lateral tube arranged at the first lateral edge and a second set of at least one lateral tube arranged at the second lateral edge, said conduit means comprising a first distributor part arranged at the first lateral edge of the turbulence generator and a second distributor part arranged at the second lateral edge of the turbulence generator, said first distributor part being fluidly coupled to the dilution header and to the first set of at least one lateral tube situated at the first lateral edge of the turbulence generator, said second distributor part being fluidly coupled to the dilution header and to the second set of at least one lateral tube situated at the second lateral edge of the turbulence generator.

8. The headbox of claim 7, wherein said first and second distributor parts are arranged adjoining the front wall of the inlet header of the headbox, said first and second distributor parts each comprising a flow duct narrowing in a direction of flow and fluidly coupled to all of said lateral tubes situated at the respective lateral edge of the turbulence generator.

9. The headbox of claim 8, wherein said flow ducts lead into the at least one lateral tube of the respective set of at least one lateral tube of the turbulence generator at a initial end of the at least one lateral tube such that said initial end of said lateral tubes in said first and second sets of at least one lateral tube of the turbulence generator are not fluidly connected to the inlet header and only the dilution liquid or stock suspension having a consistency lower than the consistency of the stock in the inlet header flows through said lateral tubes.

10. The headbox of claim 7, wherein each of said first and second sets of at least one lateral tube of the turbulence generator comprise a plurality of lateral tubes in an aligned vertical row.

11. The headbox of claim 7, wherein said conduit means further comprise a pipe leading from the dilution header to each of said distributor pieces, said control means comprising a regulation valve arranged in association with each of said pipes.

12. The headbox of claim 1, wherein the slice duct is structured and arranged to narrow in the flow direction and the turbulence generator comprises a plurality of turbulence tubes arranged in aligned horizontal rows and having end openings leading to the slice duct, further comprising thin vane parts arranged in the slice duct between the end openings of adjacent ones of the horizontal rows of the turbulence tubes of the turbulence generator.

13. The headbox of claim 1, wherein the dilution header is arranged in connection with the inlet header and is separated therefrom by a partition wall.

14. The headbox of claim 1, wherein said conduit means are structured and arranged in relationship to the headbox such that stock from the inlet header does not combine with said edge flows until a location after said turbulence generator in a flow direction of said edge flows.

15. The headbox of claim 1, wherein said turbulence generator has at least one tube arranged at each lateral edge of the headbox, said conduit means comprising a distributor part arranged at each lateral edge of the headbox interposed between the front wall of the inlet header and the at least one lateral tube arranged at the respective lateral edge of the headbox such that stock from the inlet header does not flow into the at least one lateral tube and only the dilution liquid or stock suspension having a consistency lower than the consistency of the stock in the inlet header flows into and through the at least one lateral tube.

16. The headbox of claim 1, wherein said conduit means are structured and arranged in relationship to the headbox such that only the dilution liquid or stock suspension having a consistency lower than the consistency of the stock in the inlet header flows at the lateral edges of the headbox until an end of said turbulence generator.

17. The headbox of claim 1, wherein said conduit means are structured and arranged to pass said edge flows into stock from the inlet header flowing in tubes of the turbulence generator arranged at the respective lateral edge of the headbox.

18. The headbox of claim 1, wherein a difference in pressure $\Delta p_1$ between a feed pressure of the dilution feed header and a feed pressure of the inlet header is greater than a difference in pressure $\Delta p_2$ between a feed pressure of the inlet header and pressure in the slice duct such that a wide range of regulation of the cross-direction fiber orientation profile is obtained.

19. The headbox of claim 18, wherein the inlet header, dilution feed header and slice duct are structured and arranged such that the pressure difference $\Delta p_1$ is about 3 bar and the pressure difference $\Delta p_2$ is 0.8 bar such that there is a pressure difference of about 3.8 bar between the pressure in the dilution feed header and the pressure in the slice duct, the pressure of said edge flows being regulated within this 3.8 bar pressure difference.

20. A headbox of a paper machine having a width, lateral edges and a middle region defined between the lateral edges along the width of the headbox, comprising an inlet header for stock, a slice duct from which a suspension jet of the stock is discharged, and a turbulence generator arranged between the inlet header and the slice duct, a dilution profiling system utilizing a feedback-connected regulation system to control the cross-direction basis weight profile of a paper web produced by the paper machine, the dilution profiling system comprising a dilution feed header for a dilution liquid or a stock suspension having a consistency lower than the consistency of the stock in the inlet header, means for fluidly coupling the dilution feed header to the middle region of the headbox along the width of the headbox between the inlet header and the slice duct, and regulation means associated with said fluid coupling means for regulating the flow of the dilution liquid or stock suspension having a consistency lower than the consistency of the stock in the inlet header through said fluid coupling means, the headbox further comprising conduit means arranged between the dilution feed header and the slice duct for passing flows of the dilution liquid or stock suspension having a consistency lower than the consistency of the stock in the inlet header from the dilution feed header along the lateral edges of the headbox to form edge flows such that only the dilution liquid or stock suspension having a consistency lower than the consistency of the stock in the inlet header flows at the lateral edges of the headbox until a downstream end of said turbulence generator, and control means arranged in connection with said conduit means for regulating the velocity of each of said edge flows to control a transverse velocity component of the stock suspension jet such that the cross-direction fiber orientation profile of the web produced from the stock suspension jet is controlled.

21. The headbox of claim 20, wherein a difference in pressure $\Delta p_1$ between a feed pressure of the dilution feed header and a feed pressure of the inlet header is greater than a difference in pressure $\Delta P_2$ between a feed pressure of the inlet header and pressure in the slice duct such that a wide range of regulation of the cross-direction fiber orientation profile is obtained.

22. A method for controlling the cross-direction fiber orientation profile of a paper web produced from a stock suspension jet discharged from a headbox and the basis weight profile of the web, comprising the steps of:

directing a stock suspension from an inlet header of the headbox through a plurality of turbulence tubes in a turbulence generator, the turbulence tubes being situated alongside one another in a direction transverse to the stock flow direction and in vertical rows situated in a middle region along the width of the headbox between lateral edges of the headbox, directing a dilution liquid from a dilution header through a plurality of feed ducts each leading into a respective one of the vertical rows of turbulence tubes situated in the middle width region of the headbox, regulating the flow of dilution liquid through each of the feed ducts to thereby control the basis weight profile of the web, passing flows of the dilution liquid from the dilution header along the lateral edges of the headbox to thereby constitute edge flows, and regulating the velocity of each of the edge flows to control a transverse velocity component of the stock suspension jet such that the cross-direction fiber orientation profile of the web produced from the stock suspension jet is controlled.

23. The method of claim 22, further comprising the step of measuring the basis weight profile of the web at a location downstream of the headbox, and then regulating the flow of dilution liquid through each of the feed ducts based on the measured basis weight profile of the web.

24. The method of claim 22, further comprising the step of measuring the fiber orientation profile of the web at a location downstream of the headbox, and then regulating the regulating the velocity of each of the edge flows based on the measured fiber orientation profile of the web.

25. The method of claim 22, wherein the step of passing the edge flows to both lateral edges of the headbox comprises the step of passing each of the edge flows to a respective set of turbulence tubes of the turbulence generator arranged at a respective lateral edge of the turbulence generator.

26. The method of claim 22, wherein the dilution liquid is a stock suspension having a consistency lower than the consistency of the stock suspension in the inlet header.

27. The method of claim 22, further comprising the step of combining the edge flows with the stock from the inlet header only after the turbulence generator such that only the dilution liquid flows at the lateral edges of the headbox until an end of said turbulence generator.

28. The method of claim 22, wherein a difference in pressure $\Delta p_1$ between a feed pressure of the dilution feed header and a feed pressure of the inlet header is greater than a difference in pressure $\Delta P_2$ between a feed pressure of the inlet header and pressure in the slice duct such that a wide range of regulation of the cross-direction fiber orientation profile is obtained.

* * * * *